US006547228B1

(12) United States Patent
Schmalz et al.

(10) Patent No.: US 6,547,228 B1
(45) Date of Patent: Apr. 15, 2003

(54) HOLDING DEVICE

(75) Inventors: Kurt Schmalz, Domstetten (DE); Thomas Eisele, Fluorn-Winzeln (DE); Ralf Stockburger, Glatten (DE)

(73) Assignee: J. Schmalz GmbH, Glatten (DE)

( * ) Notice: Subject to any disclaimer, the term of this patent is extended or adjusted under 35 U.S.C. 154(b) by 0 days.

(21) Appl. No.: 09/918,581

(22) Filed: Jul. 31, 2001

(30) Foreign Application Priority Data

Jul. 31, 2000 (DE) ..... 100 37 187

(51) Int. Cl.[7] ..... B25B 11/00
(52) U.S. Cl. ..... 269/21; 269/97
(58) Field of Search ..... 269/21, 22, 95, 269/97, 98, 296, 20; 451/388; 294/64.1; 279/3

(56) References Cited

U.S. PATENT DOCUMENTS

| | | | | | |
|---|---|---|---|---|---|
| 2,852,463 | A | * | 9/1958 | Gutxmer | 269/22 |
| 4,643,408 | A | * | 2/1987 | Stoll | 269/22 |
| 4,953,877 | A | * | 9/1990 | Slachta et al. | 269/22 |
| 6,286,822 | B1 | * | 9/2001 | Blick | 269/21 |
| 6,419,216 | B1 | * | 7/2002 | Susnjara | 269/21 |

* cited by examiner

*Primary Examiner*—Robert C. Watson
(74) *Attorney, Agent, or Firm*—Young & Basile, PC

(57) ABSTRACT

A holding device for work pieces to be machined, with a fixture and a vacuum holding block which can be set on the fixture, where an automatic or remotely-controllable mechanical locking device, for holding the vacuum holding block in position on the fixture is provided.

1 Claim, 5 Drawing Sheets

HOLDING DEVICE

BACKGROUND

The invention relates to holding device for work pieces to be machined, having a fixture and a vacuum holding block which can be set on a fixture.

Holding devices of this kind are known in a great number of embodiments. One or more vacuum holding blocks, which carry the work piece to be machined, are set on the fixture. The vacuum holding block is held on the fixture, either mechanically or by means of vacuum, and, in turn, holds the work piece by means of vacuum. The work piece is held by suction by the vacuum holding block and thus prevented from moving. With different work pieces, the vacuum holding block usually occupy different positions on the fixture. This means that in the event of a model change, that is to say, in the event of a change from one shape of work piece to another, the vacuum holding blocks have to be moved on the fixture. This is normally carried out manually. Then the vacuum holding blocks have to be again locked in position on the fixture, which is done either mechanically with clamping devices or pneumatically by means of vacuum. Normally tensioning levers are used as mechanical clamping devices. Since these tensioning levers have to be operated manually, the great expenditure of time in repositioning the vacuum holding blocks at a model change is regarded as disadvantageous.

A feature of the invention is therefore to continue to develop a holding device of the type described above in such a way that the vacuum holding block can be locked in position much more rapidly.

SUMMARY

It is advantageous that by means of an automatic or remotely-controlled mechanical locking device, it is no longer necessary to lock each individual vacuum holding block in position individually. Using the device according to the invention, all the vacuum holding blocks or groups of vacuum holding blocks can be locked in position together. This results in a not inconsiderable savings in time.

BRIEF DESCRIPTION OF THE DRAWING

Additional advantages, features and details of the invention can be derived from the claims and the ensuing description, in which, with reference to the drawing, particularly preferred aspects of the invention are described in detail. The features shown in the drawing, as well as those mentioned in the description and in the claims, can be essential to the invention individually by themselves or in any combination.

The drawing shows in each of FIGS. 1 to 5 a cross section of five aspects of the holding device of the invention.

DETAILED DESCRIPTION

Figure 1:
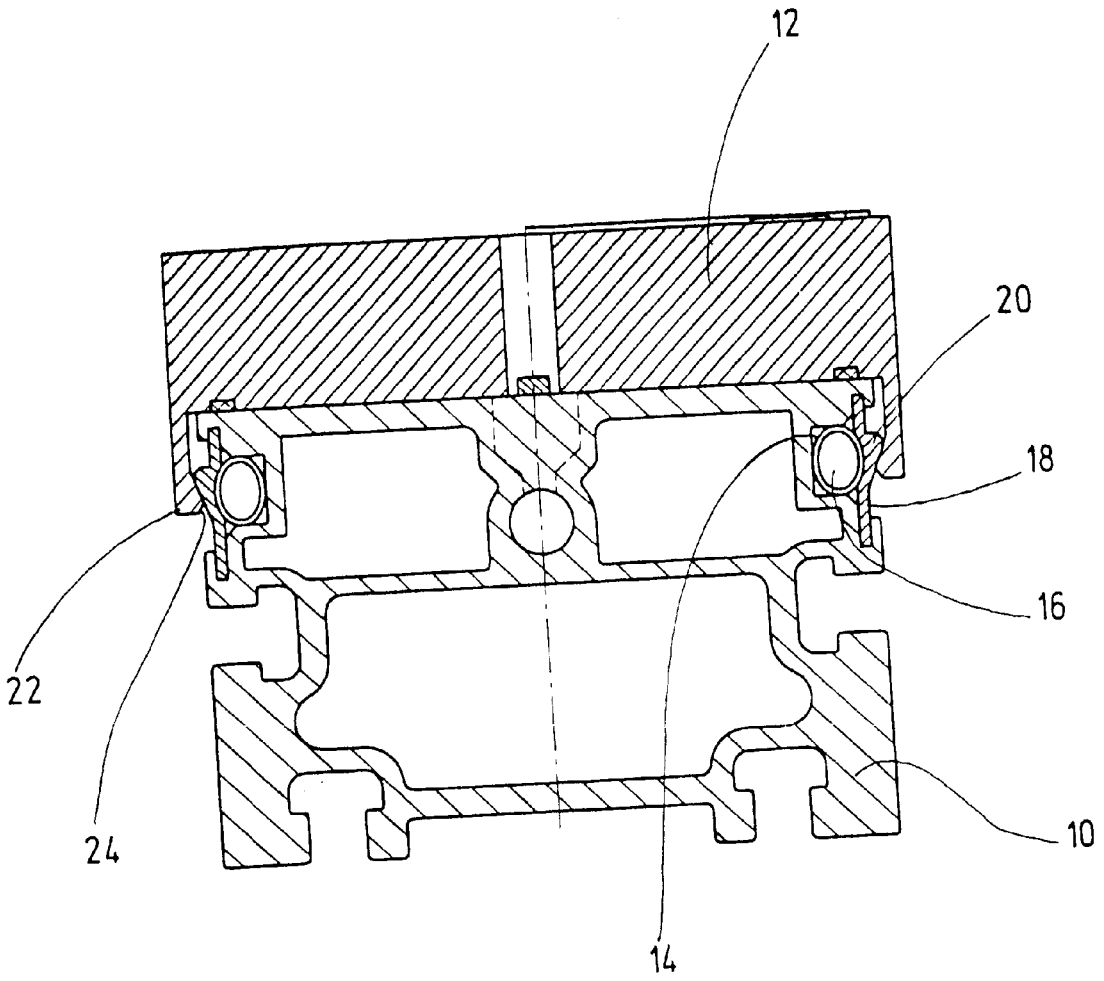

FIG. 1 shows a cross section through a first aspect of the holding device of the invention with a fixture 10, on which a vacuum holding block 12 is positioned. The fixture 10 has grooves open at the edge 14, in which pneumatic hoses 16 are carried. The hoses 16 are covered by a clamping band 18 which has a back angle tang 20 on its outside. The vacuum holding block 12 has fingers 22 extending down on its underside which have retaining tangs 24 projecting in the direction of the back angle tang 20. Both the back angle tang 20 as well as the retaining tang 24 have chamfers, which shift the vacuum holding block 12 in the direction of the fixture 10 when the pneumatic hoses 16 expand and thus press it down on the top side of the fixture 10.

Figure 2:
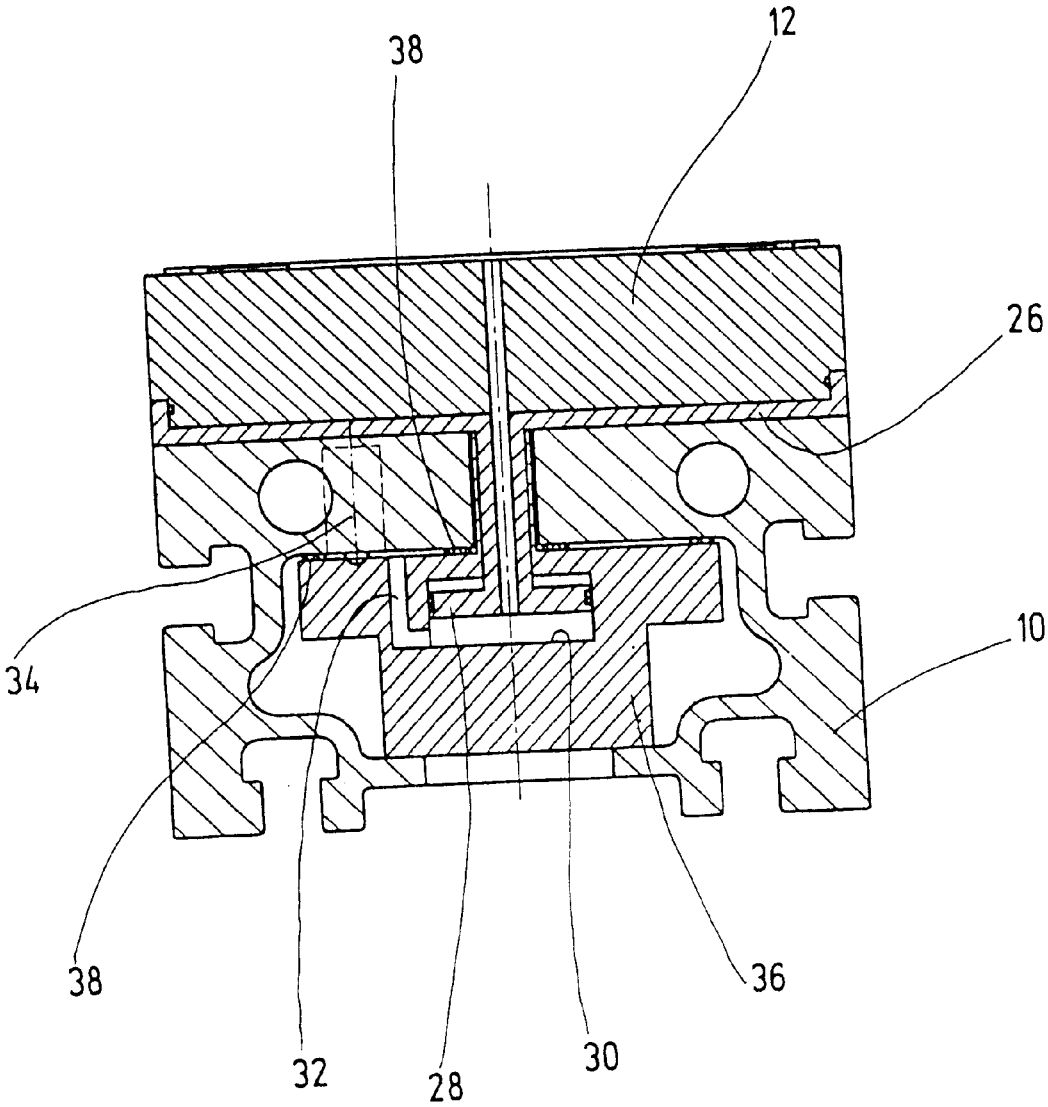

FIG. 2 also shows a fixture 10 with vacuum holding block 12, where a clamping unit 26 is snapped to the underside of the vacuum block 12. The clamping unit 26 is equipped with a piston 28 which is carried in a cylinder 30 to be movable vertically. Vacuum can be applied below the piston 28 by means of a suction line 32. In this way, the clamping unit 26 is displaced in the direction of the fixture 10 and locked against it. In turn, the clamping unit 26 keeps the vacuum holding block from moving. So that the area in which a clamping unit 26 and/or a vacuum holding block 12 is located can be supplied with vacuum, the line 32 is equipped with a valve 34. This valve 34 is, for example, configured as a momentary valve which opens when the cylinder housing 36 is touching it. Sealing is achieved by gaskets 38.

Figure 3:
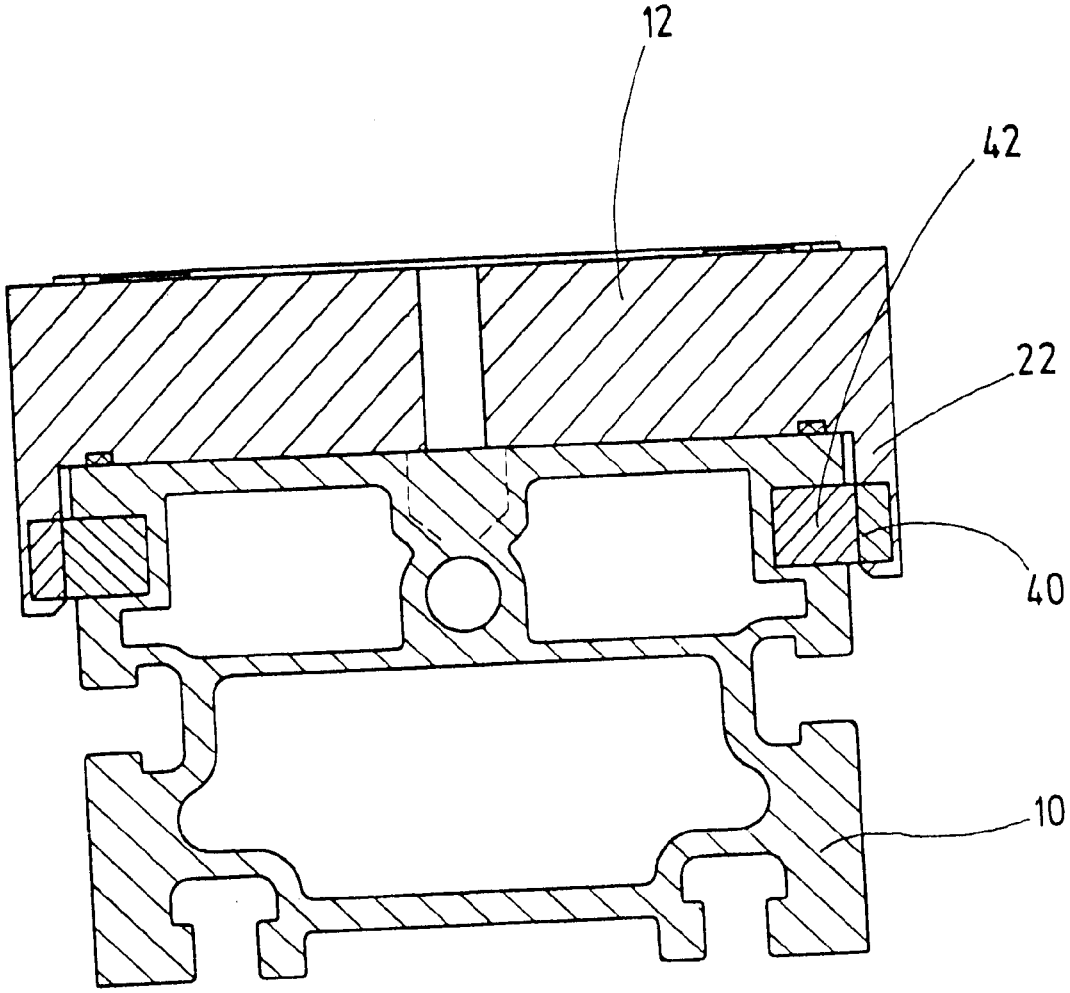

FIG. 3 also shows a fixture 10 with vacuum holding block 12, where the vacuum holding block 12, similarly to the embodiment in FIG. 1, is equipped with fingers 22 on its underside, on which magnetic or magnetizable inserts 40 are provided, which act in the direction of the fixture 40. Antipoles 42 are furnished on the fixture 10 in immediate proximity to the inserts 40. Of course, the insert 40 and antipole 42 can also be reversed, i.e. provided on the other component.

Figure 4:
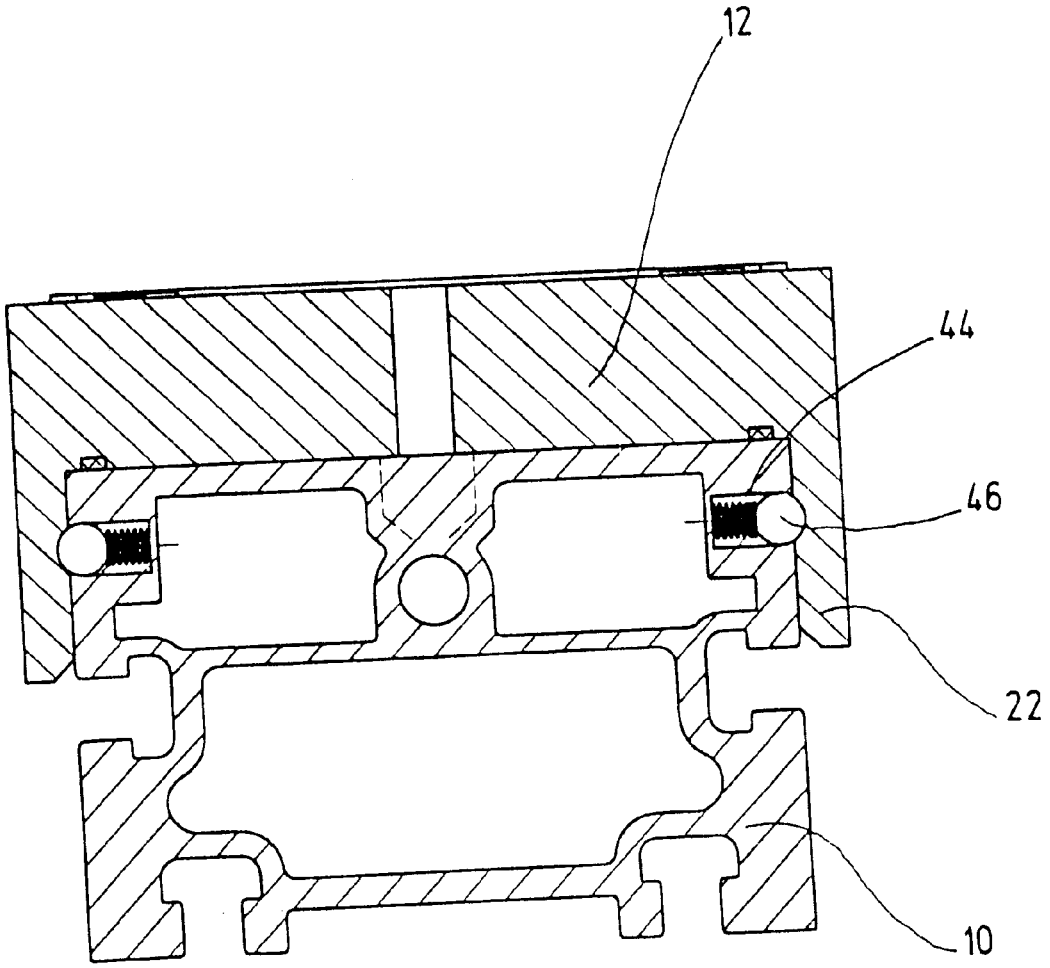

In the case of the aspect in FIG. 4, the fixture 10 is equipped with spring-loaded ball detents 44, in which a ball 46 engages a matching recess 48 on the inside of the particular finger 22 of the vacuum holding block 12.

Figure 5:
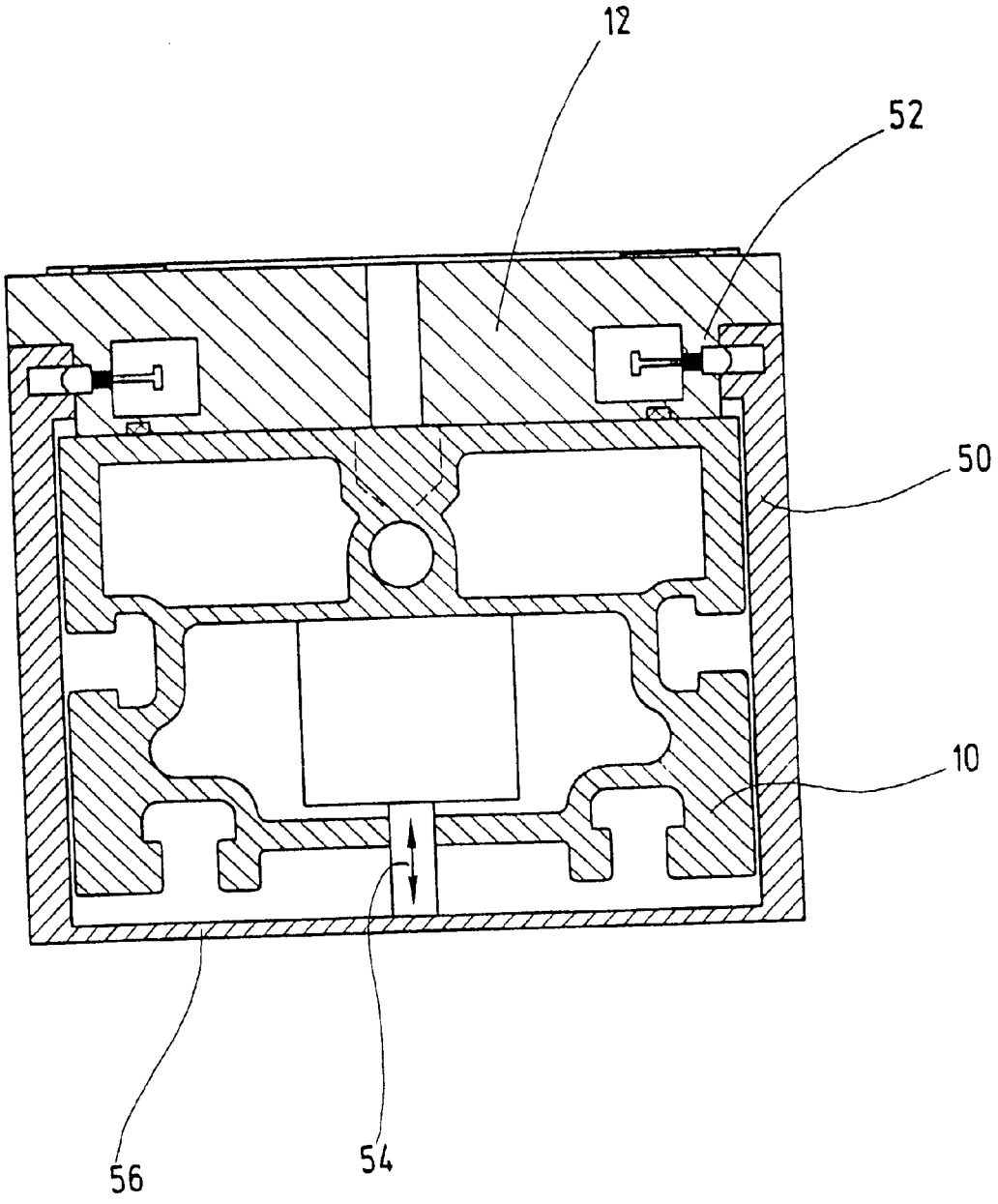

In the case of the aspect in FIG. 5, the vacuum holding block 12 is locked to a retracting rail 50, where this locking action can be carried out by means of clamping pins 52 or similar. A piston 54, which can be extended downward and which acts on a crosspiece 56 of the retracting rail 50, is located inside the fixture 10. As a result, the retracting 50 is shifted downward, and the vacuum holding block 12 is pressed down on the top side of the fixture 10.

The component 50 can also be made in an L-shape, so that the fixture 10 does not have to be completely enclosed. As a result, one side ofthe fixture 10 can be used for additional applications.

The aspects shown in the drawing allow the vacuum holding block 12 to be locked in place automatically on the fixture 10 and/or by remote-control, so that the vacuum holding blocks 12 no longer have to secured individually on the fixture 10.

What is claimed is:

1. A holding device for work pieces to be machined, with a fixture and a vacuum holding block which can be set on the fixture, characterized in that at least one of an automatic and a remotely-controllable mechanical locking device to hold the vacuum holding bock in position is provided on the fixture, wherein the locking device is an inflatable tube inserted into a groove open at an edge in the fixture, by which a means of engaging and holding can be activated.

* * * * *